United States Patent [19]

Burns, Jr.

[11] Patent Number: 4,540,445

[45] Date of Patent: Sep. 10, 1985

[54] METHOD AND APPARATUS FOR CLEANING GRIPPER ASSEMBLIES

[76] Inventor: William P. Burns, Jr., 5944 Clarendon Hills Rd., Clarendon Hills, Ill. 60514

[21] Appl. No.: 625,316

[22] Filed: Jun. 27, 1984

[51] Int. Cl.[3] ..... B08B 3/00; B08B 3/02

[52] U.S. Cl. ..... 134/21; 134/30; 15/302; 101/424

[58] Field of Search ..... 134/21, 26, 30; 15/302; 101/423, 424, 425

[56] References Cited

U.S. PATENT DOCUMENTS

| | | | |
|---|---|---|---|
| 965,117 | 7/1910 | Fichter | 101/424 |
| 2,721,566 | 10/1955 | Brucker | 15/302 |
| 2,756,455 | 7/1956 | Slaughter, Sr. | 15/306 |
| 2,788,008 | 4/1957 | Wanzer | 134/101 |
| 2,858,555 | 11/1958 | Medovick | 15/88 |
| 3,472,251 | 10/1969 | Parker, Jr. | 134/200 |
| 3,509,890 | 5/1970 | Phillips | 134/122 |
| 3,733,639 | 5/1973 | Timian | 15/304 |
| 3,775,053 | 11/1973 | Wisdom | 15/302 |
| 3,972,089 | 8/1976 | Parks | 15/345 |
| 4,342,326 | 8/1982 | Meier | 134/102 |
| 4,474,111 | 10/1984 | Holzhauser | 101/425 |

*Primary Examiner*—Richard V. Fisher
*Assistant Examiner*—Sharon T. Cohen
*Attorney, Agent, or Firm*—Fitch, Even, Tabin & Flannery

[57] ABSTRACT

A method and apparatus enable cleaning of gripper assemblies wherein the grippers are enclosed by a containment structure and cleaned by a liquid spray.

12 Claims, 10 Drawing Figures

FIG. 2
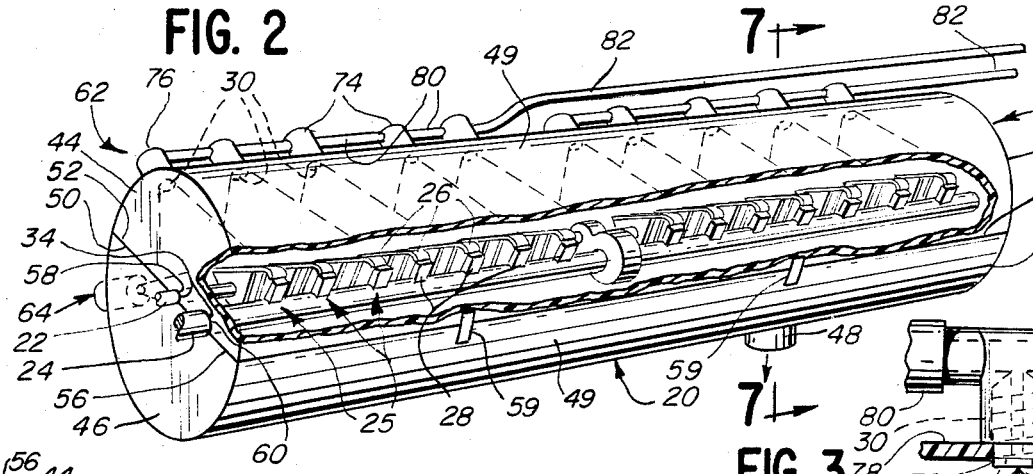
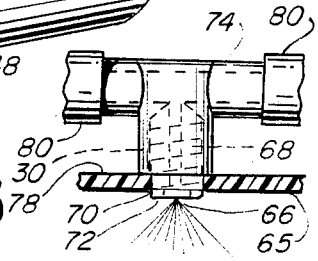
FIG. 3
FIG. 4
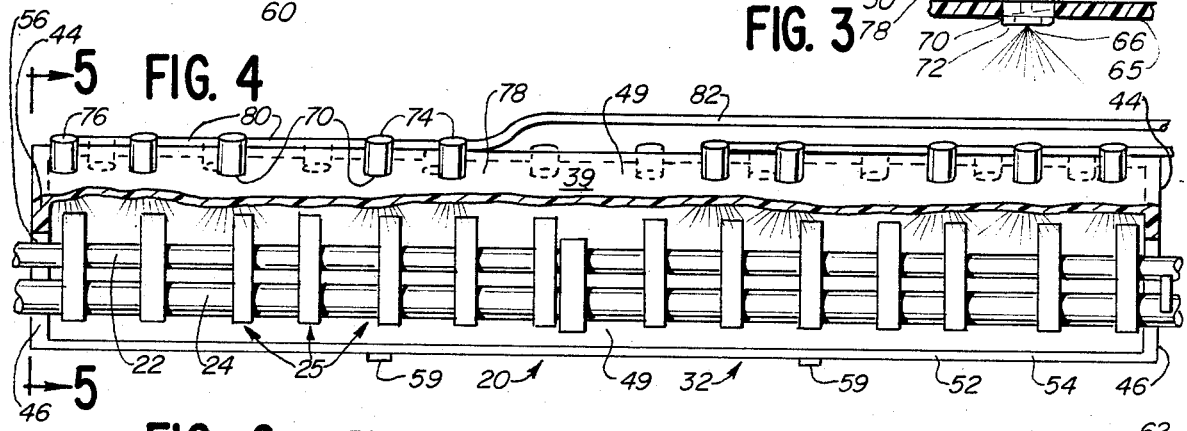
FIG. 6
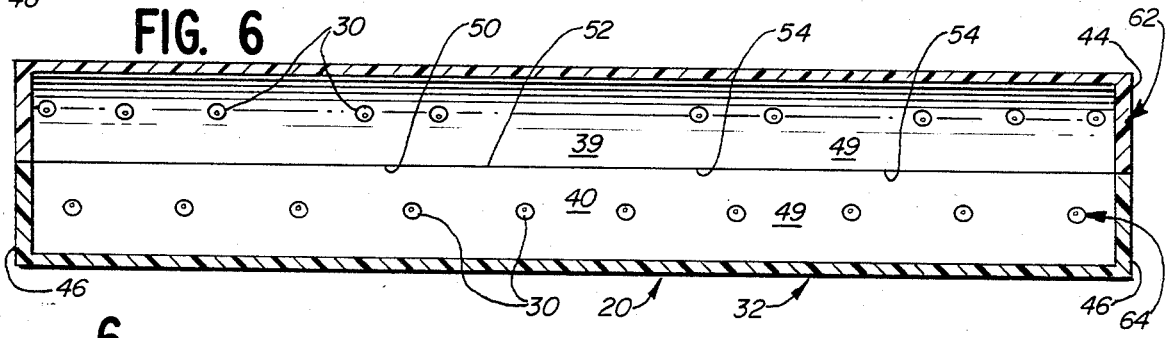
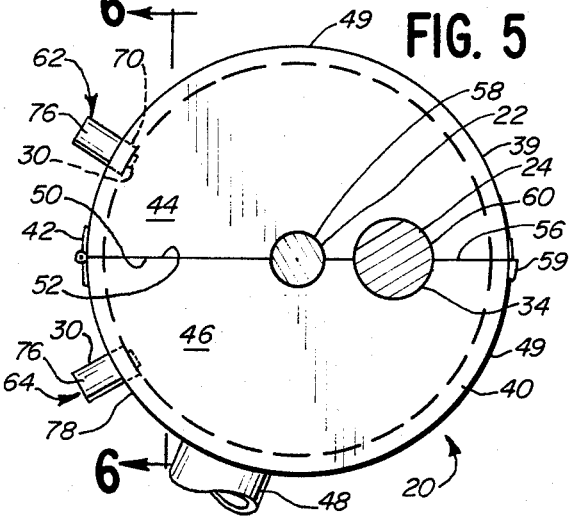
FIG. 5
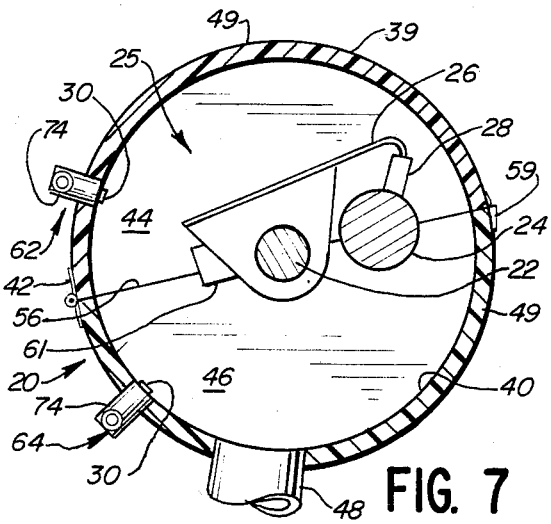
FIG. 7

FIG. 8
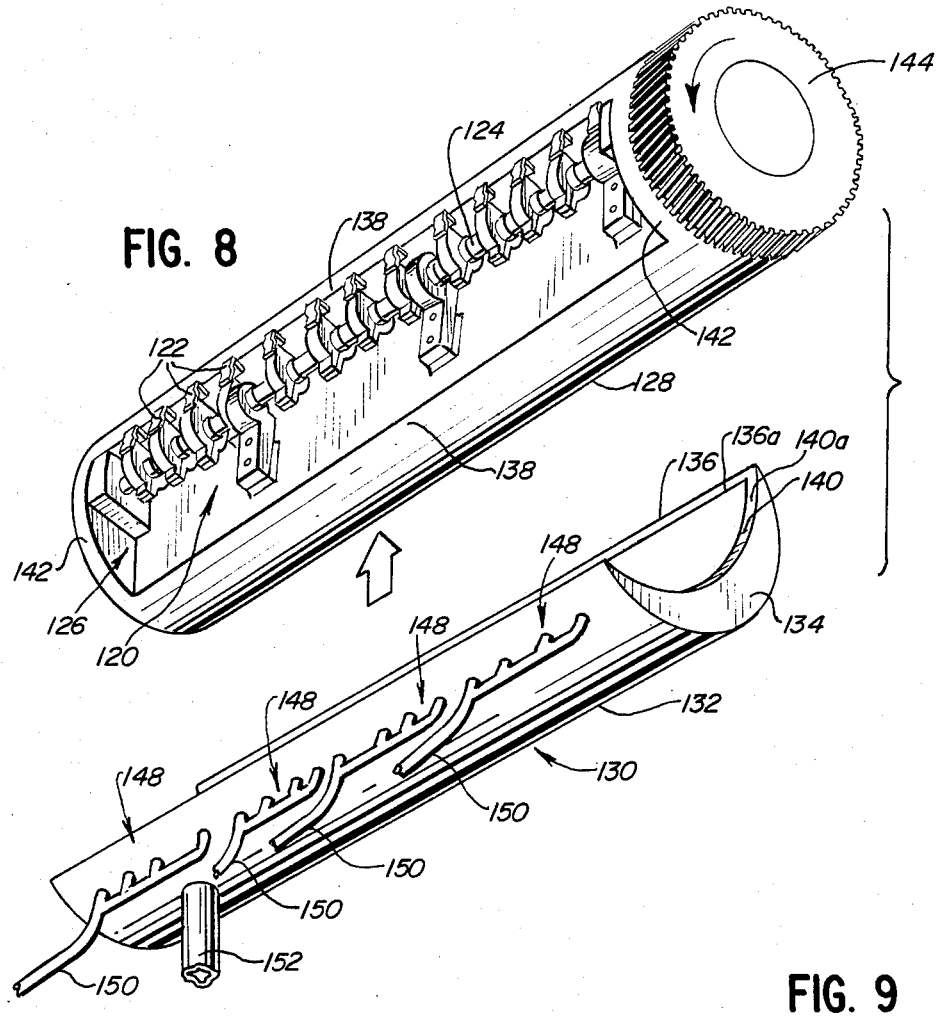
FIG. 9
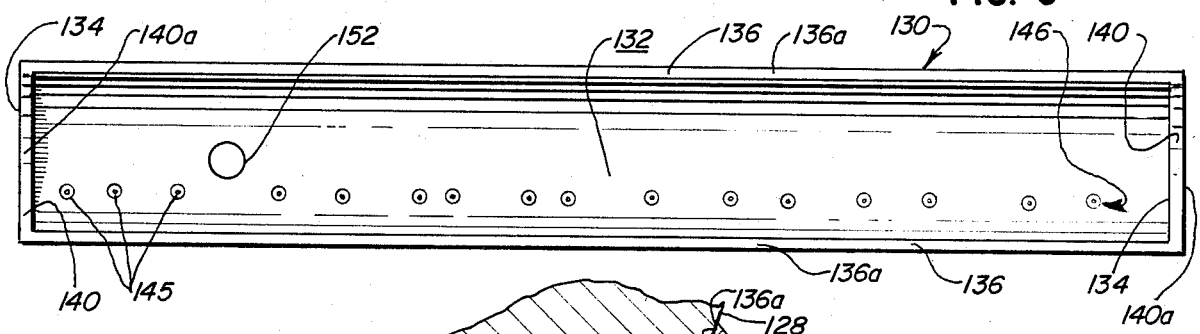
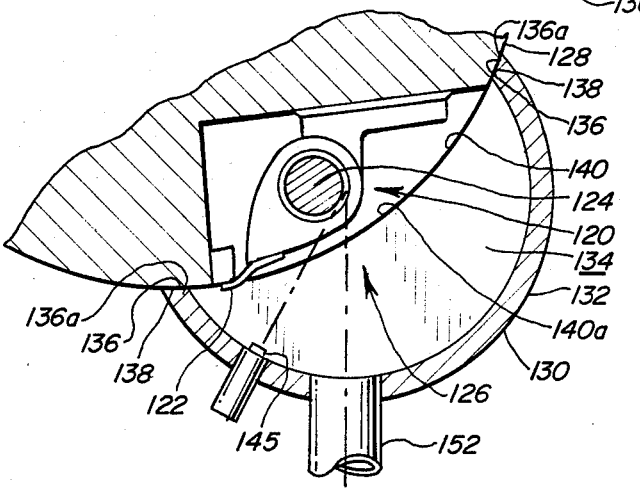
FIG. 10

METHOD AND APPARATUS FOR CLEANING GRIPPER ASSEMBLIES

BACKGROUND OF THE INVENTION

The present invention relates generally to printing apparatus and more particularly to a method and apparatus for cleaning gripper assemblies on printing presses.

A continuing problem in the operation of printing presses having gripper assemblies thereon is that paper lint and other particulate matter may collect on the gripper assemblies. One example of such particulate matter is powder which is sprayed onto freshly printed sheets so that when the sheets are stacked they are separated from one another by very thin layers of powder. Accumulation of powder, paper lint and the like is undesirable because small amounts of such matter may fall from the gripper assembly onto printed sheets, staining the sheets. Also, accumulation of such matter may interfere with opening and closing of the grippers.

In the past, deposits of such matter on gripper assemblies have generally been removed by directing pressurized air at the grippers to blow the matter off of them or by using a small broom or the like to brush it away. Neither of these methods has been satisfactory. With either of these methods, some of the powder removed from the grippers typically becomes suspended in the air and may settle on adjacent presses or other equipment. Cleaning with a brush is very time consuming. Cleaning with compressed air is messy, as particulate matter may be blown over a wide area.

Another approach has been to manually spray the grippers with a lubricating solution which cleans and lubricates the grippers simultaneously. However, such spraying has been, unsatisfactory for several reasons. First, use of such spray contaminates the surrounding environment, and commercially available lubricants which have been used in the past have been found to leave unpleasant odors after cleaning. A second problem is that the configuration of the press may restrict access to certain parts of the gripper assembly. Thus, it may be difficult to position a spray unit or hose in an orientation to direct the spray at all parts of the grippers, and it may be difficult for the person cleaning the grippers to see the parts being cleaned. A third problem is that manual spraying typically leaves excess lubricant on the grippers, and such excess lubricant tends to collect powder, paper lint and/or other particulate matter during operation of the press.

SUMMARY OF THE INVENTION

In accordance with the present invention, there are provided a novel method and apparatus for cleaning gripper assemblies wherein the grippers are enclosed by a containment structure and cleaned by a spray of cleaning fluid. The cleaning fluid is preferably mixed with air and directed at the grippers by a plurality of spray nozzles. A drain is preferably provided to enable continuous removable of fluid from the containment structure during cleaning. The structure is configured to facilitate placement thereof over the grippers in sealing cooperation with surfaces on the press adjacent the gripper assembly.

To enable the grippers to be lubricated as they are cleaned, the cleaning fluid preferably comprises a solution comprising a carrier which evaporates after the solution has been sprayed on the gripper assembly, and a lubricant which remains on the gripper assembly after the spraying operation. To remove loose particulate matter from the grippers, air is preferably blown over the gripper assembly within the containment structure prior to the spraying operation. Also, to remove excess cleaning fluid from the grippers after spraying and to aid in evaporation of the carrier, air is preferably blown over the gripper assembly after the spraying operation has been completed.

Accordingly, it is a general object of the present invention to provide a novel method and apparatus for cleaning gripper assemblies.

It is a further object of the present invention to provide a method and apparatus for removing particulate material from gripper assemblies on printing presses and containing the material removed from the grippers so that it does not contaminate the surrounding environment.

Further objects and features of the present invention are disclosed in the following description and the accompanying drawings.

BRIEF DESCRIPTION OF THE DRAWINGS

FIG. 2 is a perspective view of a portion of the gripper cleaning system of FIG. 1, shown with portions broken away and shown in installed relation on a gripper assembly.

FIG. 3 is an enlarged view of a nozzle of the gripper cleaning apparatus FIG. 1.

FIG. 4 is a plan view of the apparatus illustrated in FIG. 2, shown with portions broken away and with the gripper assembly illustrated diagrammatically.

FIG. 5 is a sectional view taken substantially along line 5—5 in FIG. 4 and looking in the direction of the arrows.

FIG. 6 is a sectional view taken substantially along line 6—6 in FIG. 5 and looking in the direction of the arrows.

FIG. 7 is a sectional view taken substantially along line 7—7 in FIG. 2 and looking in the direction of the arrows.

FIG. 8 is a perspective view illustrating a gripper assembly and apparatus for cleaning this type of gripper assembly in accordance with a second embodiment of the invention.

FIG. 9 is a plan view illustrating the interior of the gripper cleaning apparatus of FIG. 8.

FIG. 10 is a sectional view illustrating the gripper cleaning apparatus of FIGS. 8 and 9 in installed relation on the gripper assembly of FIG. 8.

DETAILED DESCRIPTION OF THE PREFERRED EMBODIMENT

Figure 1:
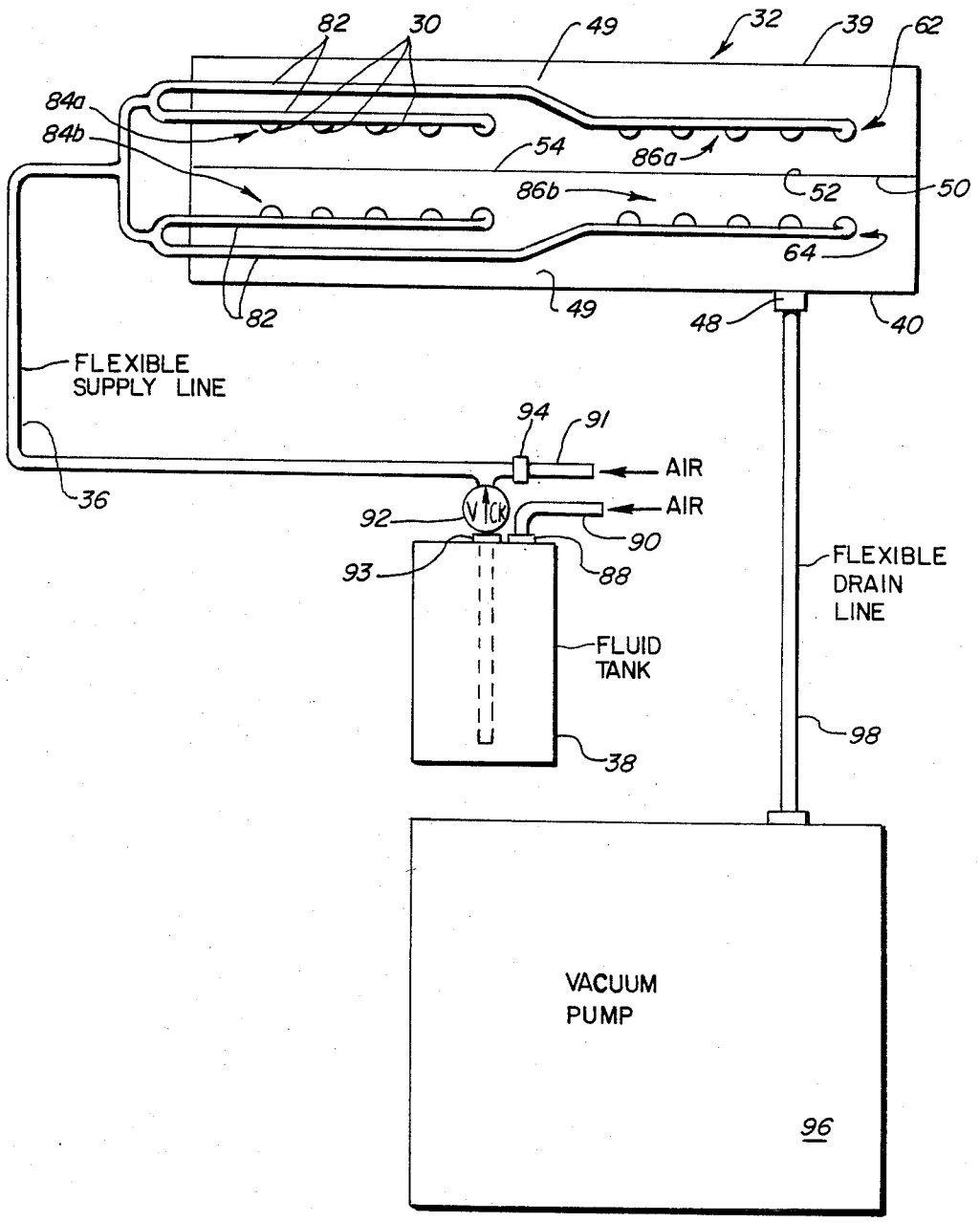
FIG. 1 is a diagrammatic view of a gripper cleaning system in accordance with one embodiment of the present invention.

The present invention is generally embodied in a method and apparatus for cleaning gripper assemblies on printing presses. Referring particularly to FIG. 2, there is shown a gripper assembly 20 comprising first and second generally horizontal support bars 22 and 24, each having a row of grippers 25 mounted thereon. Each gripper 25 includes a pair of gripper fingers 26 and gripper pads 28. FIGS. 8 through 10 illustrate a second type of gripper assembly 120, wherein a row of gripper fingers 122 is mounted on a rotatable shaft 124 journaled within a recess 126 on an impression cylinder 128.

In the past, cleaning of gripper assemblies has generally been accomplished by manually brushing the grippers, or by directing high pressure air at the grippers to blow particulate matter therefrom.

In accordance with the present invention, a method and apparatus are provided to enable gripper assembies to be cleaned by spraying cleaning fluid or solvent on the grippers while containing the cleaning fluid and material removed from the grippers to prevent contamination of the surrounding environment. Referring to FIGS. 1–7, the cleaning fluid is preferably mixed with air and directed at the grippers by a plurality of spray nozzles 30 mounted on a containment structure 32 which cooperates with surfaces 34 on the press to define an enclosure about the gripper assembly 20. Means are preferably provided to enable continuous removal of solvent from the containment structure 32 during cleaning. Fluid is supplied to the nozzles 30 by supply line 36 communicating with a fluid reservoir which is suitably pressurized.

In a first embodiment of the invention, in accordance with FIGS. 1–7, the containment structure 32 is configured for cooperation with a gripper assembly 20 having a plurality of grippers 25 supported on a pair of elongated, generally horizontal bars 22, 24. In this embodiment, the containment structure 32 includes an upper member 39 and a lower member 40 which are joined by hinges 42 and movable between an open position and a closed position. The structure 32 is placed over the gripper assembly 20 in open position and moved to closed position to provide containment for the cleaning operation. End walls 44 and 46 of the upper and lower members 39 and 40, respectively, engage the bars 22 and 24 which support the grippers 25 to prevent escape of cleaning fluid from the structure adjacent the bars 22 and 24. A mixture of cleaning fluid and air is directed at the grippers 25 by a row of spray nozzles 30 mounted on the containment structure 32. A drain 48 enables removal of cleaning fluid.

The cleaning fluid herein is preferably a liquid comprising a lubricant and a carrier which evaporates quickly after the fluid has been sprayed onto the gripper assembly 20. This enables lubricating and cleaning to be accomplished in a single neat operation.

The containment structure 32 has a generally cylindrical shape when in closed position. Each of the upper and lower members 39 and 40 has a generally semicylindrical outer wall 49 and a pair of generally semicircular planar end walls 44, 46 at its opposite ends.

The lower edge 50 of the upper member 39 is adapted for sealing cooperation with the upper edge 52 of the lower member 40 when the respective members are in closed position. To this end, the sealing edge surfaces 54 include generally linear edge surfaces 54 on the semicylindrical walls 49, each being configured for engagement with a corresponding surface on the opposite generally semicylindrical wall, and generally linear edge surface 56 on the end walls 44, 46, each being configured for engaging a corresponding surface 56 on the adjacent end wall of the opposite member. Each end wall 44, 46 further includes a pair of generally semicircular notches 58, 60 for accommodating the gripper bars 22, 24. When the respective members 39, 40 are in closed position, the semicircular notches 58, 60 cooperate to define at each end of the containment structure a pair of circular apertures, each of which has a diameter approximately equal to that of its associated gripper bar 22, 24.

Suitable latch means 59 are provided spanning the joints between the adjacent front edges of the upper and lower members 39 and 40 to maintain the containment structure 32 in closed position during operation. The latches 59 are preferably of a type providing resilient clamping force to seal the containment structure. When latched in closed position, the containment structure 32 is supported on the semicircular edges 58, 60 of the upper member 39 which engage the gripper bars 22, 24.

The upper and lower members 39 and 40 are preferably made of a relatively hard plastic material and have their edge surfaces 50 and 52 formed with sufficient precision to enable a satisfactory seal to be attained by engagement of the respective edge surfaces with one another as described above. The sealing edge surfaces could be provided with thin layers of gasket material to aid in sealing the enclosure.

It has been found that the effectiveness of the cleaning operation may vary considerably depending on placement of the nozzles 30. Referring particularly to FIG. 7, a stop mechanism 61 is located at the rear of the gripper 25. It is particularly desirable to remove powder deposits from the stop mechanism 61 as a build-up of particulate material may interfere with proper closing of the gripper 25. As noted above, it is also desirable to remove powder from all surfaces on the gripper assembly 20 to eliminate the possibility of powder deposits becoming dislodged and falling onto finished sheets. Accordingly, it has been found most effective to position the nozzles 30 in two rows 62 and 64 with each nozzle 30 directed generally at the rear of a gripper. Each nozzle 30 preferably has a relatively wide angle of dispersion so as to produce a spray pattern with an included angle of about 90°.

As illustrated in FIG. 6, the containment structure 32 is configured so as to be centered about the rear gripper assembly bar 22, and both rows 62 and 64 of nozzles are directed toward the center of the containment structure. The rows are spaced from one another by an angle of about 60° about the circumference of the containment structure. The cylindrical shape of the containment structure 32 cooperates with the placement of the nozzles 30 to provide good dispersal of spray over the entire gripping assembly 20.

It will be appreciated that compactness of the apparatus is desirable to avoid interference with parts of the press (not shown) surrounding the gripper assembly 20. However, if the containment structure 32 were too compact, the nozzles 30 would be located too close to the gripper assembly, and the areas covered by the spray from each nozzle 30 would be too small. This might prevent some areas from being adequately cleaned. To aid in achieving wide dispersion of spray from each nozzle 30, given the relatively compact containment structure 32, each nozzle 30 is mounted so that its spray outlet 66 (FIG. 3) is located only slightly inwardly of the interior surface 65 of the semicylindrical wall 49 of the containment structure.

Referring particularly to FIG. 3, each nozzle 30 has an exterior thread 68 thereon to enable it to be screwed into a threaded bore 70 in the containment structure 32, and a polygonal head 72 at its outlet end to facilitate engagement by a wrench or the like.

A total of twenty nozzles 30 are arranged in two rows 62, 64 of ten each. Each row includes two groups 84*a, b* and 86*a, b*. To provide adequate pressure to all of the nozzles 62 and 64, four supply headers 82 are provided, with each supply header 82 providing pressurized fluid and air for five nozzles 30. The number of nozzles 30 preferably exceeds the number of grippers 25 so that at least one nozzle 30 may be directed primarily at each gripper 25.

To assemble the apparatus, the nozzles are screwed into the threaded bores 70 from the interior of the containment structure 32, and T fittings 74 are screwed onto all of the nozzles 30 except that nozzles at one end of each group receive L fittings 76. The fittings 74 and 76 are screwed onto the nozzles from the exterior of the containment structure 32 and tightened against the exterior surface 78 thereof. Adjacent fittings 74 and 76 are connected to one another by suitable lengths of flexible tubing or hose 80.

As noted above, cleaning fluid is stored in a reservoir 38 which communicates with the nozzles 30 through a supply line 36. The reservoir 38 is preferably a portable tank capable of withstanding internal pressure so that air pressure within the tank 38 may be used to drive the fluid from the tank into the supply line 36.

To enable pressurization, the reservoir tank 38 preferably includes means 88 such as a conventional hose connector to enable attachment of a compressed air line 90 thereto. As press rooms are typically equipped with sources of compressed air, commonly known as "shop air", connection of an air hose 90 communicating with a source of compressed air is a simple and convenient way to provide the desired pressure in the tank.

Spraying the gripper assembly 20 with a mixture of cleaning fluid and air has been found to be an effective, relatively fast method of removing deposits. Directing high pressure air at the gripper assembly 20 prior to spraying is desirable as it removes loose material without using cleaning fluid. Also, directing high pressure air at the gripper assembly 20 after spraying is desirable as this removes excess cleaning fluid from the gripper assembly and from the interior of the containment structure 32, and helps to evaporate the carrier from the remaining cleaning fluid, leaving a relatively even application of lubricant on the gripper assembly 20.

To enable spraying of the gripper assembly 20 with a mixture of air and cleaning fluid as well as air alone, the illustrated supply line 36 includes means 94 such as a hose connector to enable connection with a second source of pressurized air, such as a second air hose 91, as well as means to enable communication with the interior of the fluid reservoir 38. To prevent back flow from the supply line 36 into the reservoir or tank 38, a check valve 92 enabling unidirectional flow from the tank is provided at the outlet 93 of the tank.

It will be appreciated that introduction of cleaning fluid and air into the interior of the containment structure 32 through the nozzles 30 increases pressure within the containment structure 32. Excessive increase in pressure is undesirable as it may cause leakage from the containment structure or may decrease the flow rate of the fluid and air, and thereby decrease the effectiveness of the spraying operation. To limit pressure increases within the containment structure 32, and to remove used cleaning fluid and material removed from the gripper assemblies during the cleaning operation, the drain 48 is preferably connected to a high volume vacuum pump 96 through a drain line 98. A conventional industrial vacuum cleaning unit, or "wet vac", may be used to provide the vacuum pumping function.

To enable placement of the containment structure in a desired location for cleaning of grippers 25 without requiring movement of the vacuum pump 96 and fluid reservoir 38, the supply line 36 and drain line 98 are preferably made of flexible tubing or hose.

The method for using the apparatus illustrated in FIGS. 1–7 begins with the step of placing the containment structure 32 in open position about the gripper assembly 20, oriented with the drain 48 extending downwardly. The containment structure 32 is then closed so that the gripper support bars 22 and 24 are within the circular apertures defined by the notches 58 and 60, and the latches 59 are latched to maintain the containment structure 32 in closed position.

The vacuum pump 96 is then activated, which may aid in sealing the structure. The second source of pressurized air is then introduced into the supply line 36 from the second source, which causes air to blow through the nozzles so as to remove loose particulate matter and the like from the gripper assembly. Such matter is withdrawn through the drain line by the vacuum pump 96. Next, the first air line 90 is pressurized, as by opening a valve, so as to raise the pressure within the fluid tank beyond the pressure in the supply line 36. This forces fluid out of the tank 38 and into the supply line 36, which enables spraying of the gripper assembly 20 with a mixture of cleaning fluid and air.

It will be appreciated that the air lines 90 and 91 may be pressurized by a single air compressor, with suitable regulators provided on the respective lines 90 and 91 to enable relatively high pressure, low volume flow through the first line 90 and higher volume, lower pressure flow through the second line 91. The nozzles 30 restrict flow through the supply line 36 to enable pressure therein to remain relatively high to provide relatively uniform flow through all of the nozzles.

During the spraying operation, the vacuum pump 96 withdraws the cleaning fluid and material removed from the gripper assembly from the interior of the containment structure 32. The vacuum pump 96 also maintains pressure in the containment structure within an acceptable range so as to minimize leakage therefrom. The pressure within the containment structure 32 during spraying typically approximates atmospheric pressure.

Depending upon the nature of the deposits on the grippers, cleaning may require spraying for a time period of about ten seconds to two minutes or more. After spraying for such a time period, the first air hose 90 is depressurized to discontinue flow of fluid from the reservoir 38 into the supply line 36. Air from the second source 91 continues to flow through the supply line 36 and through the nozzles 30 to blow excess cleaning fluid from the gripper assembly 20 and from the interior of the containment structure 32, and to evaporate the carrier from the cleaning fluid on the gripper assembly 20. After adequate drying and evaporation has been achieved, and excess fluid and vapor has been withdrawn from the interior of the containment structure 32 through the drain line 98, the second air line 91 may be depressurized and the vacuum pump 96 shut down. The latches 59 are then released and the containment structure 32 is opened and removed from the gripper assembly 20.

In the embodiment illustrated in FIGS. 8–10, the containment structure 130 comprises a single, generally semicylindrical wall 132 having generally crescent shaped end walls 134 at its opposite ends. The semicylindrical wall 132 has a pair of generally linear edge surfaces 136 extending along its length for engagement with surfaces 138 on the impression cylinder 128 adjacent the recess 126 in which the gripper assembly 120 is located. The end walls 134 have curved edge surfaces 140 thereon for engagement with correspondingly curved surfaces 142 on the impression cylinder 128 adjacent the ends 144 of the impression cylinder. The edge surfaces 136 and 140 preferably have thin layers 136*a*, 140*a* of gasket material thereon to aid in sealing.

In this embodiment, the nozzles 145 for the cleaning fluid and air mixture are arranged in a single row 146 which is divided into four groups 148 with each group having a separate supply header 150. A drain 152 enables recapture of used cleaning fluid and particulate matter. Thus, the containment structure 130 illustrated in FIGS. 8–10 to be used with a fluid reservoir, supply line, drain lines and vacuum pump as used in the embodiment illustrated in FIGS. 1–7. Each nozzle 145 is mounted on the containment structure 130 in a manner similar to that described above with respect to the embodiment of the invention illustrated in FIGS. 1–7.

The method of using the apparatus illustrated in FIGS. 8–10 begins with the step of rotating the impression cylinder 128 to a position so that when the containment structure 130 is placed over the gripper assembly as illustrated in FIG. 10, the drain 152 extends downward. After the impression cylinder 128 has been thus rotated, the containment structure 130 is placed in the position illustrated in FIG. 10, and maintained in that position with manual pressure. Then the cleaning operation proceeds as described above respecting the first embodiment.

From the foregoing, it will be appreciated that the present invention provides a novel method and apparatus for cleaning gripper assemblies on printing presses. Two embodiments of the invention have been described in detail above. In other embodiments of the invention, a different containment structure configuration or a different arrangement of nozzles might be employed to accommodate gripper assembly configurations not shown or described above. Also, in other embodiments of the invention, pumping of cleaning fluid and air through the nozzles might be accomplished by means other than shop air as described above. There is no intent to limit the invention to the embodiments described above or to any other particular embodiment.

What is claimed is:

1. In combination with a printing press, an apparatus for cleaning and lubricating gripper assemblies on the printing press comprising:

spray means for spraying cleaning fluid onto the gripper assemblies;

containment means for containing the cleaning fluid during spraying thereof by cooperating with surfaces on the press to define an enclosed interior space; and drain means for draining said cleaning fluid from said containment means;

the spray means comprising a plurality of spray nozzles mounted on said containment means and means for forcing cleaning fluid therethrough.

2. Apparatus in accordance with claim 1 wherein said drain means comprises a drain line communicating with said interior space and means for reducing pressure within said drain line below the pressure in said interior space.

3. Apparatus in accordance with claim 1 wherein said means for forcing cleaning fluid through said nozzles comprises a reservoir of cleaning fluid and a flexible supply line extending between said reservoir and said nozzles.

4. Apparatus in accordance with claim 3 wherein said means for forcing cleaning fluid through said nozzles further comprises first connector means on said reservoir to enable connection of an air hose thereto.

5. Apparatus in accordance with claim 4 further comprising second connector means on said supply line to enable connection of an air hose thereto, and a check valve on said supply line between said second connector means and said reservoir to prevent flow into said reservoir.

6. In combination with a printing press, an apparatus for cleaning gripper assemblies of the type supported on a pair of elongated bars on the printing press, the apparatus comprising:

a containment structure including an upper member and a lower member joined by at least one hinge and movable between a closed position for cooperation with said elongated bars to define a generally cylindrical enclosed interior space and an open position for permitting installation and removal of said containment structure;

spray means for directing cleaning fluid and air at said gripper assembly within said enclosed interior space; and drain means for draining said cleaning fluid from said enclosed interior space.

7. Apparatus in accordance with claim 6 wherein each of said upper and lower members includes a generally semicylindrical wall and a pair of generally planar end walls, one at each end thereof, each of said end walls having a sealing edge surface, each sealing edge surface including generally linear portions for engaging corresponding portions on the sealing edge surface of an adjacent end wall on the opposite member, and further including a pair of generally semicircular portions for cooperation with corresponding portions on the sealing edge surface of the adjacent end wall on the opposite member to define a pair of generally circular apertures for receiving said elongated bars and sealing thereagainst.

8. In combination with a printing press, an apparatus for cleaning gripping assemblies of the type supported in a recess on an impression cylinder on the printing press, the apparatus comprising:

a containment structure configured to fit against said impression cylinder to define an enclosed interior space;

spray means for directing a mixture of cleaning fluid and air at said gripper assembly within said enclosed interior space; and drain means for draining said cleaning fluid from said enclosed interior space.

9. Apparatus according to claim 8 wherein said containment structure includes a generally semi-cylindrical wall and a pair of generally crescent shaped end walls, one at each end thereof, each of said end walls having an arcuate sealing surface configured to fit against a portion of said impression cylinder in sealing engagement therewith, said semi-cylindrical wall having a pair of generally linear sealing surfaces for sealing engagement with generally linear portions of said impression cylinder between said end walls.

10. A method of cleaning a gripper assembly of the type including a plurality of spaced gripper fingers, the method comprising the steps of:

placing a containment structure in contact with surfaces on a printing press to define an enclosed interior space about said gripper assembly, said enclosed interior space being in communication with a vacuum pump to enable removal of matter from said interior space;

blowing air at said gripper assembly through a plurality of nozzles mounted on said containment structure while operating said vacuum pump;

spraying cleaning fluid onto said gripper assembly from a plurality of different nozzles mounted on said containment structure while operating said vacuum pump;

blowing air over said gripper assembly while operating said vacuum pump; and removing said containment structure from contact with said printing press.

11. A method in accordance with claim 10 wherein said nozzles are equal to or greater in number than said gripper fingers.

12. A method in accordance with claim 10 wherein the step of spraying cleaning fluid comprises pressurizing the interior of a cleaning fluid reservoir so as to force cleaning fluid into a supply line communicating with said nozzles while simultaneously forcing air through said supply line so as to deliver a mixture of cleaning fluid and air to the nozzles.

* * * * *